US008678639B2

(12) United States Patent
Tölle et al.

(10) Patent No.: US 8,678,639 B2
(45) Date of Patent: Mar. 25, 2014

(54) MIXING MACHINE

(75) Inventors: Ulrich Tölle, Detmold (DE); Wolfgang Rüberg, Menden (DE)

(73) Assignee: Dr. Herfeld GmbH & Co. KG, Neuenrade (DE)

( * ) Notice: Subject to any disclaimer, the term of this patent is extended or adjusted under 35 U.S.C. 154(b) by 819 days.

(21) Appl. No.: 12/717,166

(22) Filed: Mar. 4, 2010

(65) Prior Publication Data

US 2010/0226200 A1 Sep. 9, 2010

(30) Foreign Application Priority Data

Mar. 4, 2009 (DE) ..... 20 2009 001 937 U

(51) Int. Cl.
*B01F 9/08* (2006.01)

(52) U.S. Cl.
USPC ..... 366/200; 366/245

(58) Field of Classification Search
USPC ..... 366/185, 244, 245, 200, 221–224
See application file for complete search history.

(56) References Cited

U.S. PATENT DOCUMENTS

| | | | | |
|---|---|---|---|---|
| 277,250 | A * | 5/1883 | Espel | 366/149 |
| 499,890 | A * | 6/1893 | Savage | 366/185 |
| 1,489,538 | A | 4/1924 | Menk | |
| 1,986,530 | A | 1/1935 | Read | |
| 2,959,869 | A | 11/1960 | Ackerman | |
| 3,191,874 | A | 6/1965 | Drinkwater | |
| 3,318,537 | A | 5/1967 | Ake | |
| 3,407,511 | A | 10/1968 | Camm | |
| 3,853,458 | A | 12/1974 | Wurr | |
| 3,869,247 | A | 3/1975 | Deussner | |

(Continued)

FOREIGN PATENT DOCUMENTS

| | | |
|---|---|---|
| DE | 1262235 B | 3/1968 |
| DE | 2504126 A1 | 8/1975 |

(Continued)

OTHER PUBLICATIONS

U.S. Appl. No. 12/788,193, filed May 26, 2010; First Named Inventor: Ulrich Tölle.

(Continued)

*Primary Examiner* — David Sorkin
(74) *Attorney, Agent, or Firm* — Margaret Polson; Oppedahl Patent Law Firm LLC

(57) ABSTRACT

A mixing machine 1 includes a mixing head 3 displayed with one or several elements 12 for connecting the same to a container 5 containing a mix to form a closed mixing receptacle containing the mix. The mixing head 3 is mounted pivotably relative to a frame 2 in such a way that the mixing receptacle formed from mixing head 3 and container 5 is pivotable to execute the mixing process. The mixing machine 1 further includes a device for producing a mix stream and at least one rotary-driven mixing tool interacting in the mix stream. The mix-stream-producing device is designed to produce a low-energy primary mix-stream as a feed stream for supplying the mix contained in the mixing receptacle to the at least one mixing tool W2 disposed in the mixing head 3 interacting in the primary mix-stream produced by the mix-stream-producing device. The at least one mixing tool W2 is provided to produce a secondary mix-stream containing only a fraction of the mix contained in the mixing receptacle as a cross-stream to the primary mix-stream.

14 Claims, 5 Drawing Sheets

(56) References Cited

U.S. PATENT DOCUMENTS

| | | | | |
|---|---|---|---|---|
| 3,897,934 | A | 8/1975 | Phillips | |
| 3,910,756 | A | 10/1975 | Henning | |
| 4,100,613 | A * | 7/1978 | Shaeffer | 366/143 |
| RE30,649 | E * | 6/1981 | Thompson | 366/170.2 |
| 4,289,279 | A | 9/1981 | Brandt | |
| 4,432,650 | A * | 2/1984 | Langen et al. | 366/147 |
| 4,781,468 | A | 11/1988 | Herfeld | |
| 5,427,947 | A | 6/1995 | Dalos | |
| 5,865,538 | A | 2/1999 | Walker et al. | |
| 2001/0019515 | A1 | 9/2001 | Schmidt et al. | |

FOREIGN PATENT DOCUMENTS

| | | | |
|---|---|---|---|
| DE | 4104399 | | 8/1992 |
| DE | 4419598 | A1 | 12/1995 |
| DE | 19809476 | A1 | 9/1999 |
| EP | 0225495 | | 6/1987 |
| EP | 1123731 | A2 | 8/2001 |
| FR | 2492680 | A1 | 4/1982 |
| FR | 2567415 | | 1/1986 |
| GB | 1102975 | | 2/1968 |

OTHER PUBLICATIONS

European search report in related divisional application EP 12157516.1, Mar. 2012.

Office action in co-pending Chinese application 201010122207.8, Aug. 2013.

* cited by examiner

MIXING MACHINE

CROSS REFERENCE APPLICATIONS

This application claims the benefit of German Application No. 20 2009 001 937.3, filed Mar. 4, 2009, which is incorporated herein by reference for all purposes.

BACKGROUND

Industrial mixers are used to mix bulk material, typically powdered bulk material which are used to form a mixture of synthetic granulates, as well as in the dye industry. These mixing machines have a mixing head which is mounted pivotably relative to a frame, and which also serves to close up a container containing the material to be mixed. The container is connected to the mixing head for the purpose of the mixing the material. A closed mixing receptacle is formed from the mixing head and the container containing the mix by connecting the container to the mixing head. The mixing head has one or several connecting elements for the purpose of connecting the container to the mixing head, for example, an encircling flange. This mixer is also operated as a container-mixer since in these mixing machines a container containing the mix is connected to the mixing head. The mixing head is disposed pivotably relative to the frame of the mixing machine. In operation the mix is disposed in an overhead position relative to the mixing head, with the mixing head is lowermost and the connected container is uppermost.

Such previously known container-mixers have a device for producing a mix stream. An axially disposed tool in the mixing head produces the mix stream, which is rotary-driven by a motor. Such a tool has several blades projecting radially from the drive shaft forming a type of propeller. One such container-mixer is known from EP 0 225 495 A2. There may be several such tools are disposed on the drive shaft. In prior art mixers, this tool serves as a mixing tool and during operation of the mixer therewith produces a mix clump with the mix contained in the mixing receptacle. The mix is flung upward in an axial area by means of the mix tool or tools and is then deflected radially outward by gravity on the inside of the receptacle back to the tool. In the previously described mixing tool, a mix stream is produced in which contains the whole mix found in the mixing receptacle. The mixing process results from the acceleration of the mix at the mixing tool or tools and the turbulence in the mix stream.

A second motor-driven mixing tool is disposed in the wall section of the receptacle interacting radially in applications in which more energy is to be introduced into the mix by the mixing tools. The second motor-driven mixing tool has a higher rpm relative to the rotation speed of tools used to produce the mix clump. Several such radially disposed mixing tools can be provided. The at least one mixing tool provides further energy input into the mix clump produced by the feed tool thereby improving particle dispersion and supporting the mixing process. The formation of a high-energy mix clump is required for the mixing process in the design of such mixing machines. The particles in the mix clump are supplied to each mix at a rate of about 20 m/sec with these previously known mixing machines.

With industrial mixing machines, an effort is made to reach the desired thorough mixing in the shortest time possible. However, when thorough mixing is possible in a shorter time with higher tool rotations than with more slowly rotating tools, care is taken to prevent too much heat from being introduced into the material to be mixed. This must be carefully watched with a mix of synthetic granulates since the individual granulate particles can stick to one another and/or stick to the tool if too high of temperature is reached. Therefore, in the previously described mixing machines, the mixing time is limited to prevent the first and the second mixing tools from getting very hot during operation and preventing the skin friction of the particles on the inside of the receptacle heating up the mix.

The foregoing example of the related art and limitations related therewith are intended to be illustrative and not exclusive. Other limitations of the related art will become apparent to those of skill in the art upon a reading of the specification and a study of the drawings.

SUMMARY

A procedure for mixing powdered or granulated materials with a mixing machine is disclosed. The mixing machine includes a mixing head having at least one element for connecting the mixing head to a container holding the material to be mixed, thereby forming a closed mixing receptacle containing the mix. The mixing head is pivotably mounted in a frame such that the mixing receptacle formed from mixing head and container can be pivoted to execute the mixing process. The mixing head includes a device for producing a mix stream and at least one rotary-driven mixing tool interacting in the mix stream. The mixing machine includes a mixing head having at least one element for connecting the mixing head to a container containing a mix to form a closed mixing receptacle containing the mix. The mixing head is mounted pivotably in a frame in such a way that the mixing receptacle formed from mixing head and container can be pivoted to execute the mixing process. The mixing head includes a device for producing a mix stream and at least one rotary-driven mixing tool interacting in the mix stream.

In one embodiment a procedure is carried out in which a low-energy primary mix-stream is produced, using the mix-stream-producing device as a feed stream to supply the mix contained in the mixing receptacle to at least one mixing tool, by means of which mixing tool a secondary mix-stream, including only a fraction of the mix found in the mixing receptacle but responsible for the actual mixing process, is produced as a cross-stream to the primary mix-stream serving as the feed stream.

In one depicted embodiment of mixing machine, the mix-stream-producing device for producing a low energy primary mix-stream is designed as a feed stream for supplying the mix contained in the mixing receptacle to the at least one mixing tool disposed in the mixing head and interacting in the primary mix-stream produced by the mix-stream-producing device and that the at least one mixing tool for producing a secondary mix-stream including only a fraction of the mix contained in the mixing receptacle is provided as a cross-stream to the primary mix-stream.

The following embodiments and aspects thereof are described and illustrated in conjunction with systems, tool and methods which are meant to be exemplary and illustrative, not limiting in scope. In various embodiments, one or more of the above described problems have been reduced or eliminated, while other embodiments are directed to other improvements.

In this procedure (the same holding true for the mixing machine disclosed), a feed stream, which is designated as the primary mix-stream within the scope of this embodiment, is produced with the mix-stream-producing device. The whole mix found in the mixing receptacle is included in this primary mix-stream. This mix stream serves to supply the mix to at least one mixing tools, which each produce a secondary mix-stream as a cross-stream to the feed stream. Only a fraction of the mix included in the mixing receptacle is picked up by the at least one mixing tool. This at least one secondary mix-stream is responsible for the actual process of mixing the mix contained in the mixing receptacle.

A special feature of this procedure, and a mixing machine so designed, is that the process of mixing is occurring in only a fraction of the mix contained in the mixing receptacle at any one time. The mix is supplied by the mix-stream-producing device successively to the mixing tool or tools, making the primary mix-stream function as a feed stream. The orientation of the secondary mix-stream is transverse to the flow direction of the primary mix-stream for which the primary mix-stream is designed. As a result, the mix contained in the mixing receptacle is supplied successively and periodically to the mixing tool or tools for executing the actual mixing. An advantage of this design is that the primary mix-stream functioning as the feed stream can be generated with a minimum of energy input into the mix. This is because the stream mainly feeds the mix contained in the mixing receptacle to the mixing tool or tools. The mixing tool can be executed with a small size, and a correspondingly smaller-sized drive, since the at least one mixing tool produces a secondary mix-stream which has a comparatively small mix volume relative to the primary mix-stream.

In addition, this design allows for several mixing tools to be disposed in the path of the primary mix-stream, all of which operate according to the above-mentioned principle. If several such mixing tools are provided, each of these tools can be designed differently. It is therefore possible to equip the mixing head with one or several dispersing tools and one or several homogenizing tools. With such a mixing machine a mix can be optimally mixed according to specific requirements, because the individual mixing tools are different and can also be controlled independently of one another if desired. These can be operated individually or as a whole to achieve a mix result. This possibility and the separation of the mix motions in a primary mix-stream as a feed stream and a secondary mix-stream as a mixing stream, allows better control and differentiated adjustment of procedure parameters of the mixing process.

If a dispersing tool is involved with which a higher-energy or high-energy secondary mix-stream is produced, the energy input into the mix stream is also relatively small in such mixing tool. For one thing, the particles in each of the secondary mix-streams are delayed for only a certain time before they are released from the secondary mix-stream in the sequence of the feed processes of the primary mix-stream. Consequently, these particles released from the secondary mix-stream get an adequate opportunity to cool off before they are supplied to it again or to a further mixing tool by the rotation of the primary particle stream.

A correspondingly pivotable suspension of the mixing receptacle serves as a mix-stream-producing device to produce a primary mix-stream. The primary mix-stream is then produced by a corresponding movement of the mixing receptacle. Such a movement of the mixing receptacle can be a swinging and/or a swaying motion. Here the pendulum axis is preferably moved about a rotational axis in discrete steps.

In another embodiment, the primary mix-stream is produced by at least one rotary-driven feed tool disposed in the mixing receptacle. In such an embodiment, the primary mix-stream is fed concentrically to the rotational axis of the feed tool, which rotational axis preferably corresponds to the longitudinal axis of the mixing receptacle. In one embodiment, such a feed tool is a tool with its floor-scraping shaft reaching through to the floor of the mixing head, driven at a low rpm, including at least one floor-scraping paddle. In this embodiment, the travel path of the at least one paddle of the feed tool is arranged at a greater radial distance from the shaft of the feed tool than the shaft of the mixing tool relative to the shaft reaching through to the floor of the mixing head. Consequently, the paddle runs radially to the outside of the tool or tools of the mixing tool relative to the shaft of the feed tool. The feed tool is designed to be floor-scraping, such that no residue can accumulate at the floor of the mixing receptacle so that it is not supplied for further thorough mixing.

Since little or no energy is introduced into the primary mix-stream serving as the feed stream, there is little chance that mix particles will stick to these tools. Thus, cleaning this mixing machine, especially its feed tool, is easier and faster.

In the depicted embodiment, a floor scraper feed tool has at least one feed arm designed as a helix segment, which is disposed on the outside of the mixing tool or tools radially in relation to the shaft of the tool. The floor of the receptacle portion of the mixing head is disposed in the area of the shaft penetration of the mixing tool or tools. To grab mix found on the floor of the receptacle portion of the mixing head the feed tool has at least one paddle. The paddle has a recess pointing radially inward in the depicted embodiment. The paddle itself extends to the vicinity of the shaft of the feed tool. The recess serves allow the feed arm to move past to the mixing tool or tools. The feed arm designed as a helix segment extends from the paddle to a height above the upper edge of the mixing tool. It is thus ensured that a mix-material distribution occurs in adequate amount.

At the diameter of a smaller-sized mixing head, the shaft of the mixing tool or tools is typically disposed at an angle to the shaft of the feed tool.

In addition to the exemplary aspects and embodiments described above, further aspects and embodiments will become apparent by reference to the accompanying drawings forming a part of this specification wherein like reference characters designate corresponding parts in the several views.

Figure 1:
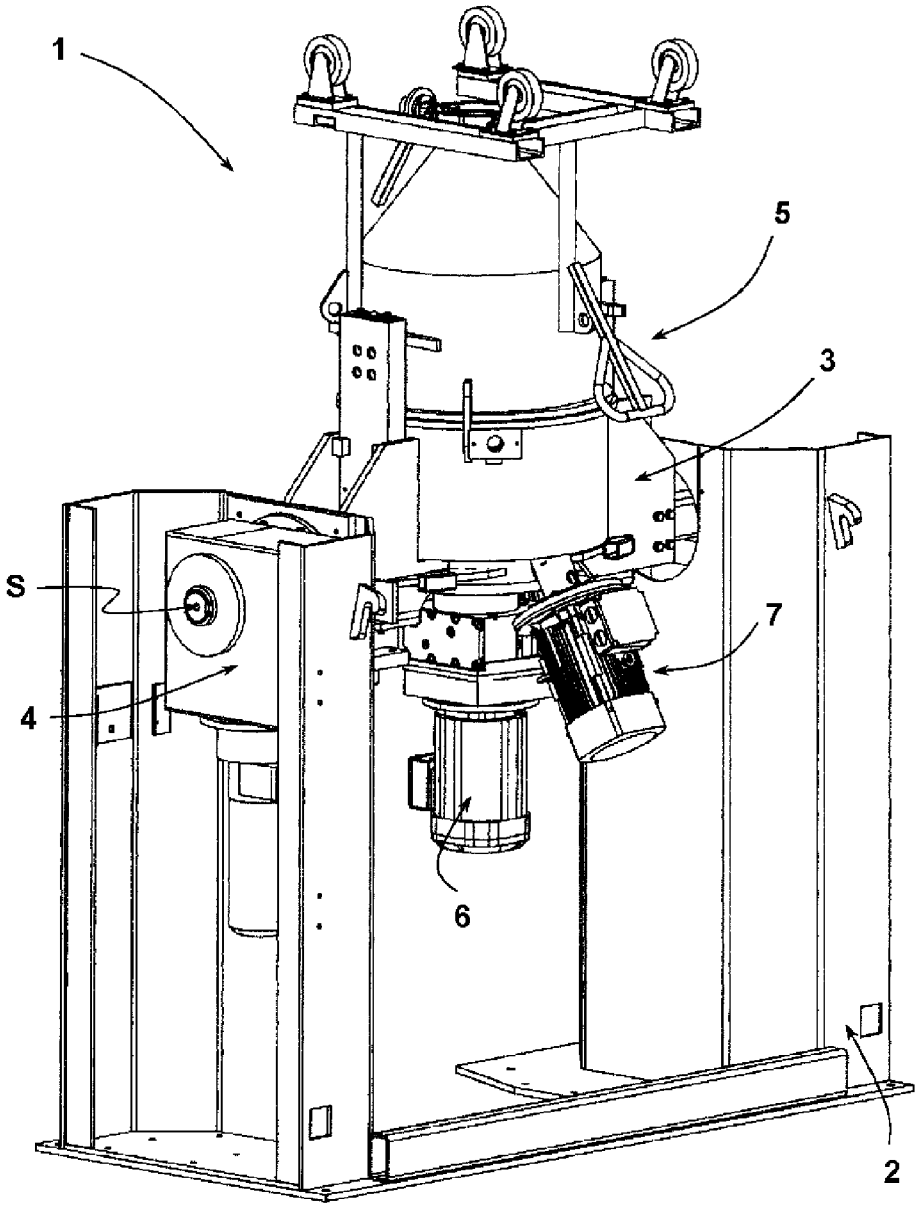
FIG. 1 is a schematic perspective view of a mixing machine with a container in the mixing position, containing a mix, itself closed at the mixing head.

Before explaining the disclosed embodiment of the present invention in detail, it is to be understood that the invention is not limited in its application to the details of the particular arrangement shown, since the invention is capable of other embodiments. Exemplary embodiments are illustrated in referenced figures of the drawings. It is intended that the embodiments and figures disclosed herein are to be considered illustrative rather than limiting. Also, the terminology used herein is for the purpose of description and not of limitation.

DETAILED DESCRIPTION OF THE DRAWINGS

A mixing machine 1 for industrial use has a frame 2, on which a mixing head 3 is pivotably mounted. The pivot axis of the mixing head 3 is indicated by the reference letter S in FIG.

1. The mixing head 3 is movable by a drive 4 at least 180° about its swing axis. In the depicted embodiment, the pivotability of the mixing head 3 allows a user to connect a mix container 5, as a container containing a mix, to the mixing head 3 when the machine is in a position rotated about 180° from its position in FIG. 1. The user then swings the connected mix container 5 and mixing head 3 (the true mixing receptacle) into the mixing position of the mixing head 3 shown in FIG. 1. The mixing head 3 of the mixing machine 1 is at the bottom in this position. As a result, the mix contained in the mix container 5 falls onto the tool disposed in the mixing head 3.

The mixing head 3 of the depicted embodiment has two tools, which are each driven by an electric motor. A first electric motor 6 drives a feed tool; a second electric motor 7 drives a mixing tool.

Figure 2:
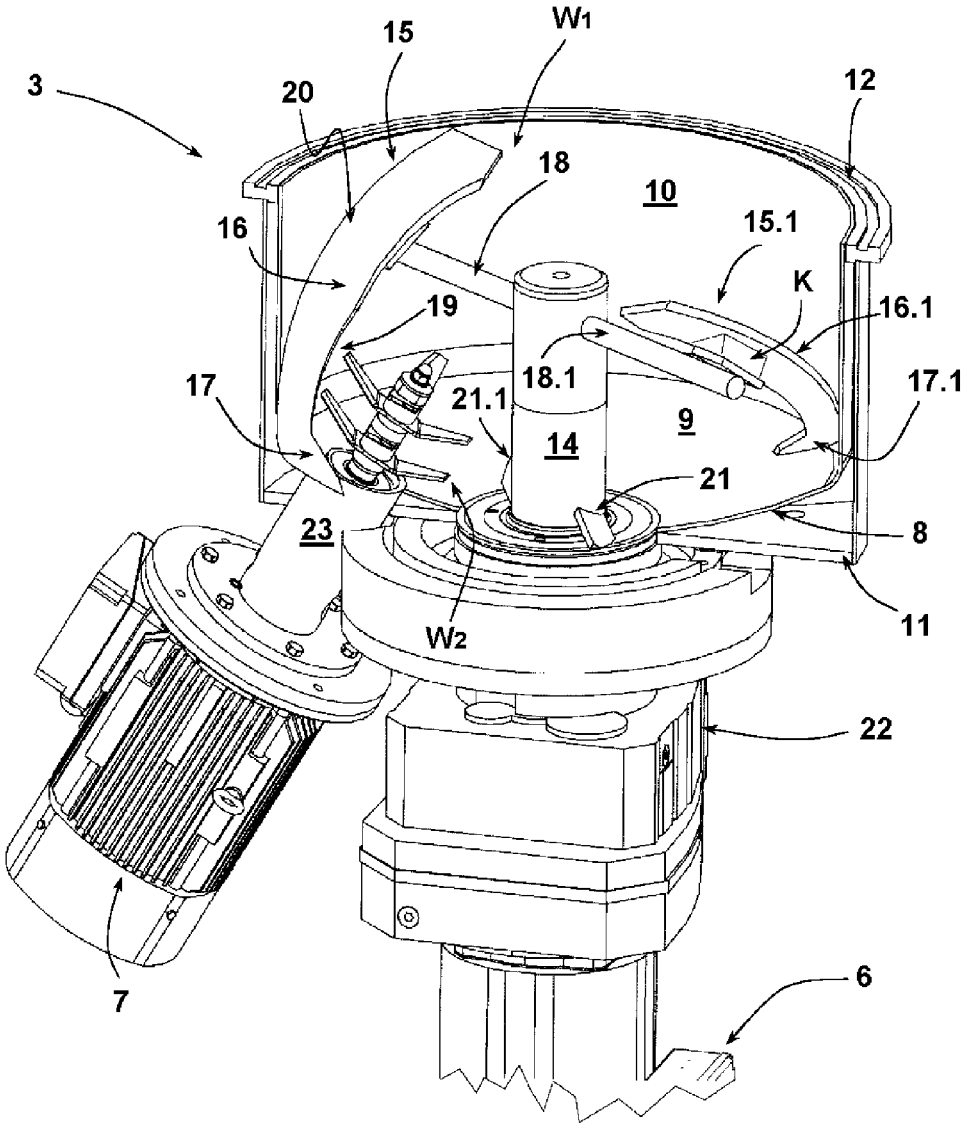
FIG. 2 is a partial perspective sectional inside view into the mixing head of the mixing machine from FIG. 1.

FIG. 2 shows the mixing head 3 with its tools $W_1$, $W_2$ in a perspective view. The mixing head 3 has a receptacle portion 8 with a floor 9 and a cylindrical wall section 10 formed thereto. The transition from the floor 9 to the wall section 10 is executed by forming a defined radius. The receptacle portion 8 is enclosed in a housing 11. The housing 11 supports a coupling flange 12 at its open end, to which a complementarily designed coupling piece of the mixing container 5 lies flat to an edge on the mixing head 3. Therefore, the coupling flange serves as an element to connect a container containing a mix, in this case the mix container 5 to the mixing head 3 in the depicted embodiment.

The tool $W_1$ driven by the electric motor 6 is designed as a feed tool and its shaft 14 penetrates the floor of the receptacle portion 8 at the center. The shaft 14 of the tool $W_1$ consequently runs along the longitudinal axis of the mixing receptacle and thus parallel to the cylindrical wall section 10, which concentrically encloses the shaft 14. The feed tool $W_1$ of the mixing machine 1 includes two feed arms 15, 15.1 in the depicted embodiment. The feed arm 15 is described below. The feed arm 15.1 is identically constructed. Both feed arms 15, 15.1 are disposed at an angular distance of 180° from one another. The feed arm 15 is designed as a helix segment and has a curved helix section 16. The helix segment 16 supports a paddle 17 at its lower end. A small gap for movement remains between the lower edge of the paddle 17 and the top side of the floor 9. The helix segment 16 is held on a rod 18, which is connected to the shaft 14. The rod 18 extends radially to the shaft 14. The helix segment 16 is continuously curved from its paddle 17 up to its upper edge and is inclined inward in the direction toward the shaft 14. In FIG. 2, this is most recognizable at a gusset K of the feed arm 15.1, by means of which the helix segment 16.1 is connected to the rod 18.1. The inclination of the helix segment 16 serves to compensate for the centrifugal force acting during the operation of the feed tool $W_1$ for the purpose of opposing the accumulation of material on the inside of the wall section 10 of the receptacle portion 8 and thus supporting the desired redistribution in the vertical direction. A recess 19 is introduced into the helix segment 16 in its lower section. For this reason, the paddle 17 is widened compared to the recess 19 and extends radially inward. The radial outer edge 20 of the helix 16 is carried a short distance to the inside of the wall section 10.

In the depicted embodiment, the feed tool $W_1$ has two auxiliary tools 21, 21.1 connected to the shaft 14 immediately above the shaft 14 penetration through the floor 9 in addition to the two feed arms 15, 15.1. The auxiliary tools 21, 21.1 are designed as single blades which are turned in the rotation direction of the tool, $W_1$. The auxiliary tools 21, 21.1 conduct the mix stream generated by the feed arms 15, 15.1 radially outward from the shaft 14. The feed tool $W_1$ is driven by the electric motor 6 and an interconnected transmission 22 which rotates slowly during the operation of the mixing machine 1. The rotation speed of the feed tool $W_1$ is adjusted such that the mix is fed by means of a low-energy primary mix-stream. In the depicted embodiment, the primary mix-stream is a circulating feed stream that supplies the mix to a mixing tool $W_2$ described below.

The mixing head 3 additionally has a mixing tool $W_2$ that is driven by the electric motor 7. The shaft 23 of the tool $W_2$ is at an angle to the rotational axis of the shaft 14. This arrangement was chosen in the mixing machine 1 shown in the figures. As a result, the mixing blades of the tool $W_2$ are disposed at a sufficient distance from the inside of the wall section 10 and from the travel path of the feed arms 15, 15.1. The recess 19 of the helix segments 16, 16.1 of the feed arms 15, 15.1 serves to grab mix material out of the area of the shaft 23 penetration through the floor 9,. The mixing tool $W_2$ is designed as a dispersing tool in the depicted embodiment. Its mixing blades are driven during operation of the mixing machine 1 at an appropriate rpm, which exceeds the rpm of the feed tool $W_1$ by some multiple.

Figure 3:
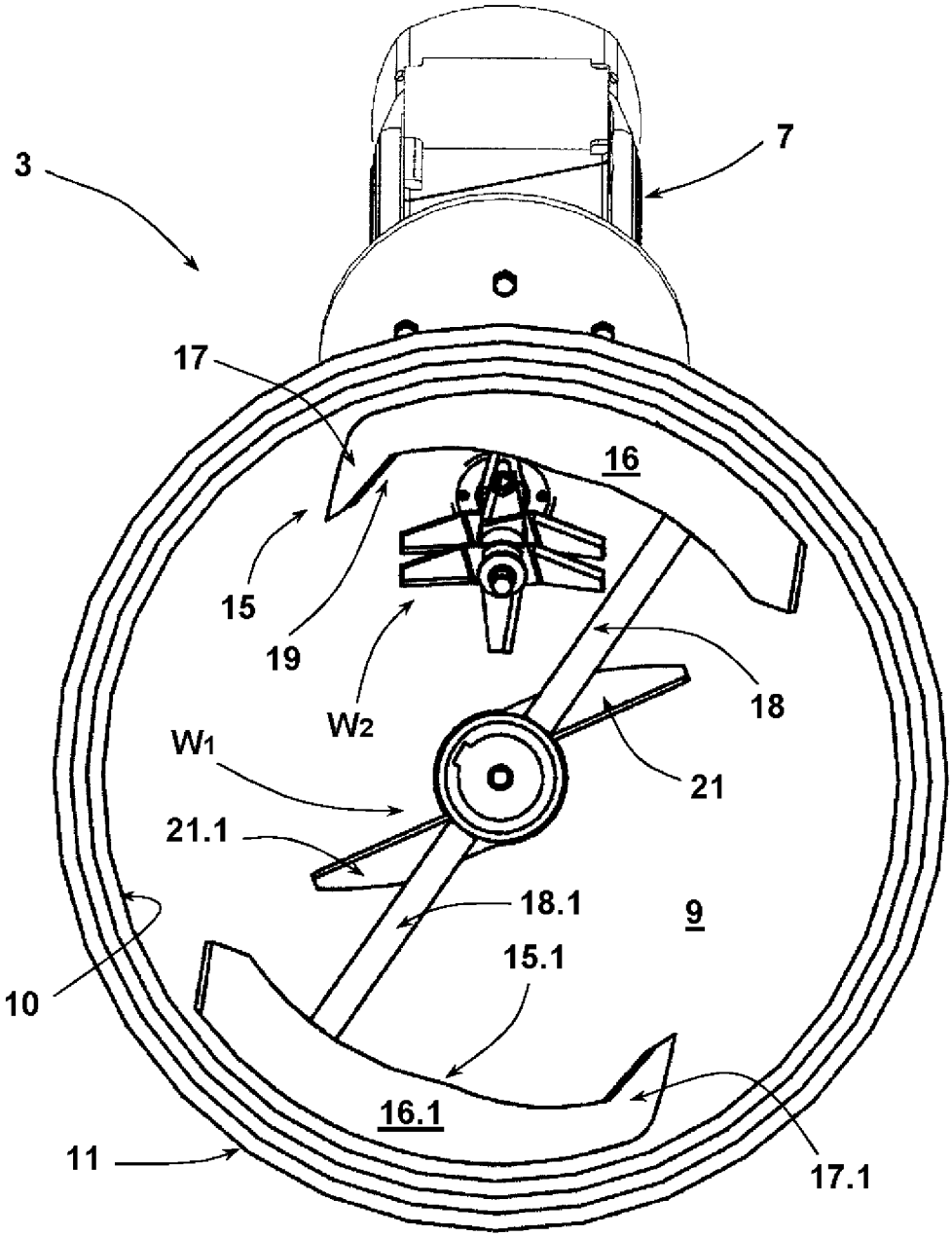
FIG. 3 is a plan view of the mixing head of FIG. 2.

FIG. 3 shows in a schematic plan view the arrangement of the shaft 14, the two feed arms 15, 15.1 with their paddles 17, 17.1, and the two auxiliary tools 21, 21.1 to one another and in relation to the tool $W_2$. The housing 11 and the wall section 10 of the receptacle portion 8 are represented as a polygon in FIG. 3 for simplicity on the rendering. Actually, these elements are executed as continuously curved.

The mixing machine 1 or its mixing head 3 is operated for mixing a mix contained in the mixing container 5 shown in FIG. 1 in the mixing position of the mixing head 3 with the mixing container 5 connected thereto. The mixing container 5 is located in this position in its overhead position, so that the mix falls through the open top side into the receptacle portion 8 of the mixing head 3 with the tools $W_1$, $W_2$ contained therein. The feed tool $W_1$ is driven for mixing by the electric motor 6, operating as a floor scraper, in order to redistribute the mix lying on the floor 9 of the receptacle portion 8, and to lift it off from the floor 9 and lift it up over the wall section 16, 16.1 of the two feed arms 15, 15.1 and over the upper end of the helix segments 16, 16.1, and also dump it in a subordinate manner in the direction of the shaft 14. Consequently, the feed arms 15, 15.1 operate like a kind of plow. Using the auxiliary tools 21, 21.1, the material supplied by the helix segments 16, 16.1 is brought radially outward and thus is again supplied to the paddles 17, 17.1 of the feed arms 15, 15.1.

With the feed tool $W_1$, a low-energy primary mix-stream is produced where the mix and the particles sharing in this mix stream are moved at a rate of about 1-5 m/sec due to the low rpm. The feed rate to be achieved is dependent on the material to be mixed. The supply of material by the feed tool $W_1$ consequently occurs concentrically about the shaft 14.

The feed tool $W_1$ does not serve just for redistribution, but also, significantly, to supply the mix to the mixing tool $W_2$ responsible for the actual mixing process. This tool $W_2$ is driven at a higher rpm and generates a secondary mix-stream operating transverse to the primary mix-stream. In the depicted embodiment, the mix particles are fed at a rate of 30-40 m/sec in the secondary mix-stream. As a result, the actual mixing process of the mix occurs by means of the tool $W_2$ used for dispersion. In the migration of the primary mix-stream, the mix particles are supplied to the tool $W_2$, are grabbed from the primary mix stream and linked in the secondary mix-stream, The mix is then pushed away from the secondary mix-stream after a certain delay time by the mix in the primary mix stream pushing more mix to be supplied to the mixing tool $W_2$. This process is repeated until the desired mix result occurs.

The description of the two mix streams, the primary mix-stream and the secondary mix-stream disposed transverse to it, makes it clear that for the most part, mix found in the mixing receptacle is part of the primary mix-stream, and that only a fraction of the mix contained in the mixing receptacle is part of the secondary mix-stream. Consequently, a separation takes place in the mixing machine 1 between a mix stream primarily as transport and feed for supplying the mix to the appropriate mixing tool and a secondary mix-stream, which is the actual mix stream responsible to a considerable extent for the mixing process.

In the embodiment example depicted, the feed tool $W_1$ has two helix segments 16, 16.1, each with a paddle 17 or 17.1 in the near-floor area. At constant rotation rate of the feed tool $W_1$, supply of mix to the mixing tool $W_2$ results in different intensities, whereby this mix-supply motion is at its greatest when a helix segment 16 or 16.1 falls below a certain minimum distance to the tools of the mixing tool $W_2$ and then goes past on the outside. Such a mix supply can in the broadest sense be said to be a pumped supply of material.

In the embodiment example being described, the mix particles are moved about 8-10 times faster in the secondary mix-stream than in the primary mix-stream.

Figure 4:
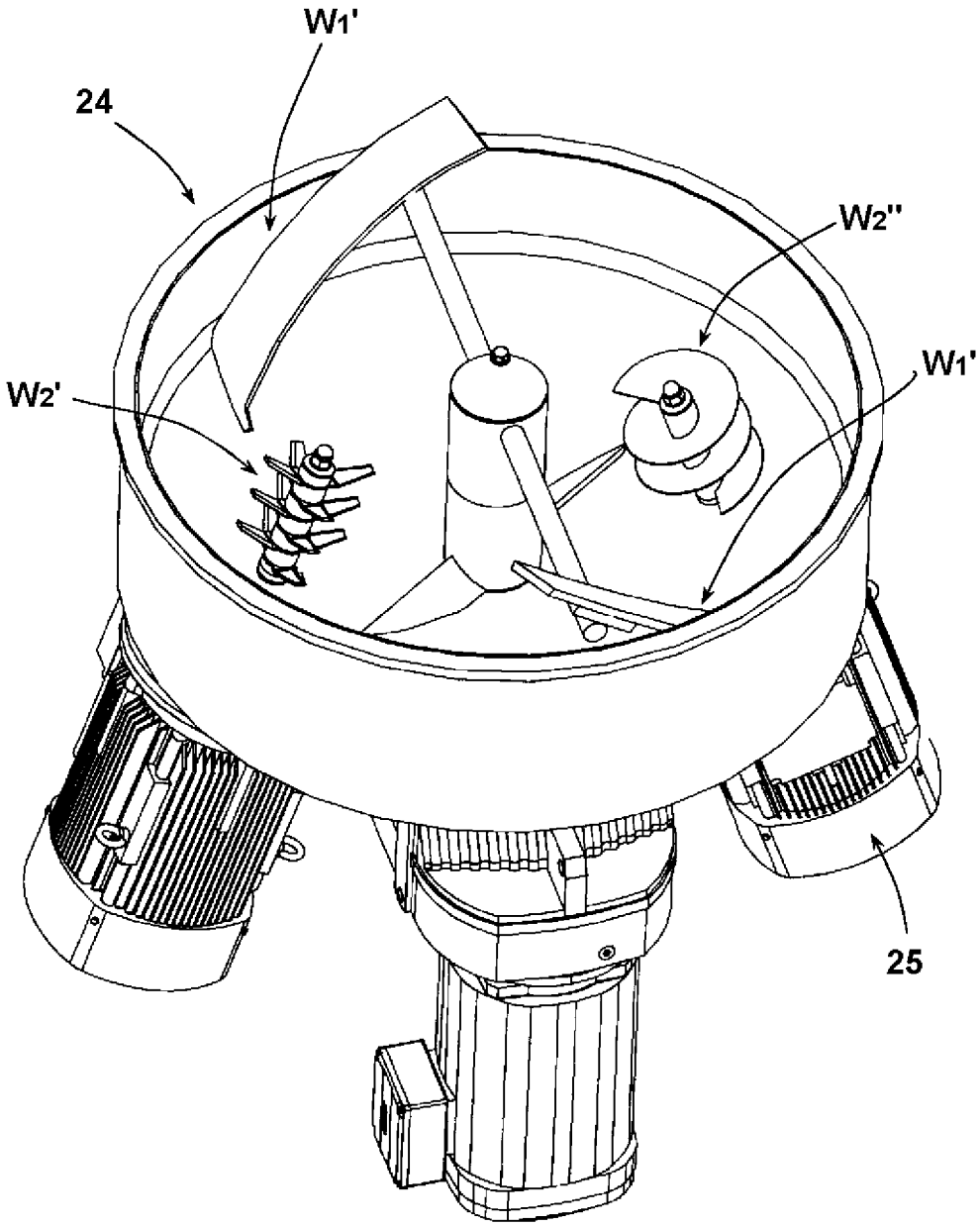
FIG. 4 is a perspective view into a mixing head according to a further embodiment of a mixing machine corresponding to that of FIG. 1.

FIG. 4 shows the mixing head 24 of a further mixing machine, the rest not being depicted in detail. The mixing head 24 is designed the same way with respect to its feed tool $W_1'$ as that described for the mixing head 3 in the previous embodiment. Unlike mixing head 3, the mixing head 24 has two mixing tools $W_2'$ and $W_2''$. The mixing tool $W_2'$ is constructed as a dispersing tool, just like the mixing tool $W_2$ of the mixing head 3. The two mixing tools $W_2'$ and $W_2''$ are disposed lying diametrically opposite from one another relative to the rotation axis of the feed tool $W_1'$. The mixing tool $W_2''$ is designed as a type of feed coil. The mixing tool $W_2''$ is a homogenizing tool, with which a low-energy secondary-mix-stream is produced. The mixing tool $W_2''$ is likewise driven by an electric motor 25.

Depending on the material to be mixed and/or the mix result to be achieved, either the mixing tool $W_2'$ or the mixing tool $W_2''$ or both of the mixing tools $W_2'$, $W_2''$ operate to each produce a secondary mix-stream. Consequently, the mixing head 24 can be used for mixing very different materials, and without a change of tools.

In order to facilitate use of the mixing head 24, controls can be provided for the mixing tools $W_2'$ and $W_2''$, as well as the feed tool $W_1'$, to select their speed (rpm) depending on the material to be mixed and the mix result desired. In addition to individual controls for the tools $W_1'$, $W_2'$, and $W_2''$ on a service panel, the control quantities "dispersing" and "homogenizing" can be provided as adjustment variables. If a higher dispersion of the mix is desired, generally the rotation rate of the mixing tool $W_2$40 is increased. This can be linked with a reduction in the rotation rate of the other mixing tool $W_2''$. This is correspondingly true for a higher or lower homogenization which might be desired during the mixing process. Likewise, the rotation rates of the feed tool W1' can be linked to achieve a desired mix result in optimizing the operation of the tools of the mixing head 24.

Figure 5:
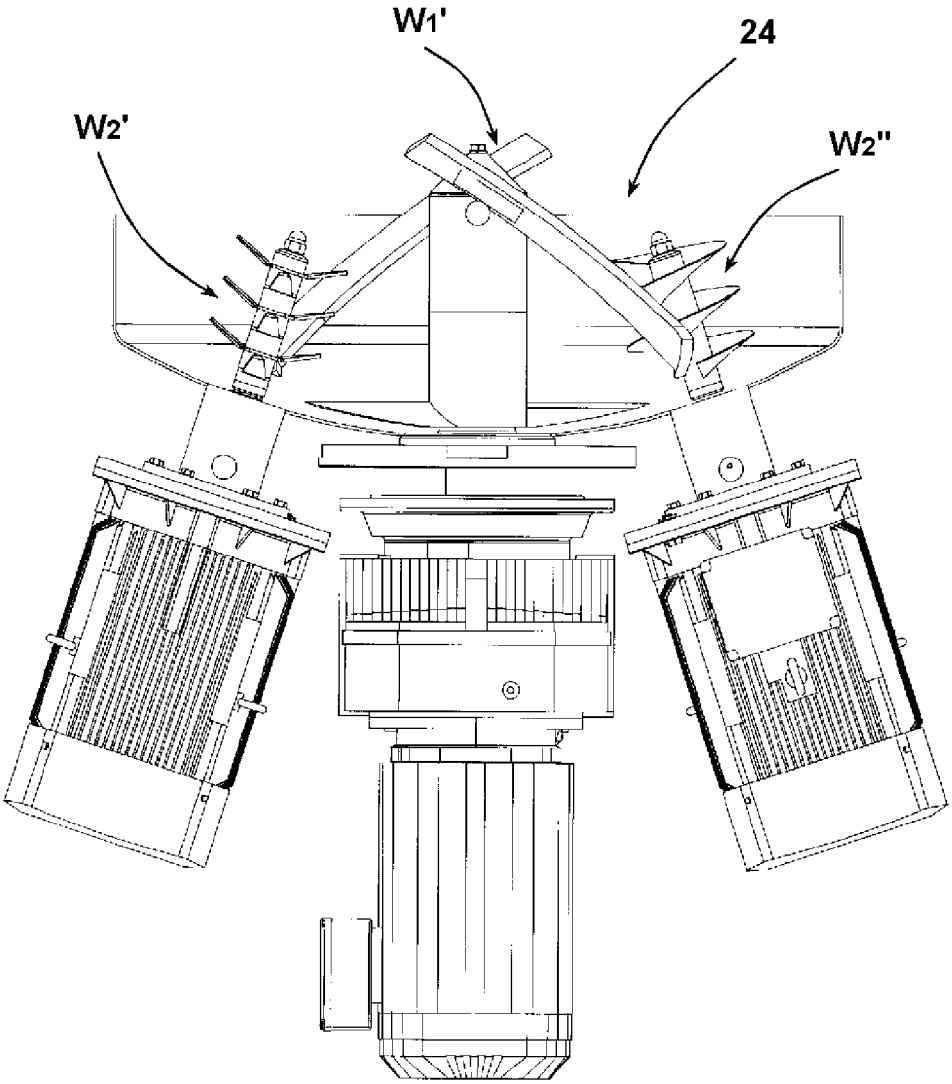
FIG. 5 is a sectional representation through the mixing head of FIG. 4.

FIG. 5 is a sectional representation of the mixing head 24 to show the angled arrangement of the rotation axes of the mixing tools $W_2'$ and $W_2''$ to the longitudinal axis of the mixing head 24.

With the mixing head 24, it is also possible to realize different stages of the mixing process in a single mixing process. Thus, with the mixing head 24 in a first mixing stage, the dispersing tool can be used primarily as a mixing tool $W_2'$, to achieve a dispersion and crushing associated therewith. At a later mixing stage, the rpm of the dispersing tool $W_2'$ is reduced or this tool $W_2'$ is completely disconnected, and a phase of homogenization follows, in which the homogenizing tool $W_2''$ is operated either exclusively or primarily as the mixing tool. If further mixing tools are contained in a mixing head, further partial mixing steps can be run.

In the concept of producing several mix streams and a reduced energy input thereby, for the case in which a dispersing tool is available as a mixing tool, the particle size in the mixed material can be adjusted with a relatively narrow grain-size range. This is primarily based on the fact that the dispersing tool need not be prematurely disconnected as a result of increasing heating, as is the case in conventional mixing machines.

If desired, the pivotable arrangement of the mixing head 3, 24 is used to set the mixing head 3, 24 in a swaying or parallel motion together with the mixing container 5. The mixing process can hereby be supported.

As a result of the previously described multiple-stream concept (a primary mix-stream and at least one secondary mix-stream disposed transverse thereto), a mixing process can also result with a smaller degree of filling in the mixing receptacle. While with conventional; container mixes, filling must be provided of at least 60%, in order to form a mix clump necessary for the mixing process, with the procedure described and the mixing machine described, satisfactory mix results can also be achieved with mixing receptacles that are only 40% filled with mix.

In the present description, a dispersing tool is described as a mixing tool as well as a homogenizing tool designed as a feed coil. Because the mixing tools in the designs described are not responsible for the redistribution of the material, other mixing tools can also be used, such as coil tools or segment coils and so-called feed coils, which are composed of individual coil segments. The individual coil segments may be paddle-shaped. These may be adjustable with respect to their inclination.

While a number of exemplary aspects and embodiments have been discussed above, those of skill in the art will recognize certain modifications, permutations, additions and sub-combinations therefore. It is therefore intended that the following appended claims hereinafter introduced are interpreted to include all such modifications, permutations, additions and sub-combinations are within their true spirit and scope. Each apparatus embodiment described herein has numerous equivalents.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims.

Reference Numbers

1 Mixing machine
2 Frame
3 Mixing head
4 Drive
5 Mixing receptacle
6 Electric motor
7 Electric motor
8 Receptacle portion
9 Floor
10 Wall section
11 Housing
12 Coupling flange
14 Shaft
15, 15.1 Feed arm
16, 16.1 Helix segment
17 Paddle
18, 18.1 Rod
19 Recess
20 Edge
21, 21.1 Auxiliary tool
22 Transmission
23 Shaft
24 Mixing head
25 Electric motor
$W_1$, $W_1'$ Feed tool
$W_2$, $W_2'$, $W_2''$ Mixing tool

We claim:

1. A mixing machine comprising:

a mixing head having at least one element for connecting the mixing head to a container containing a mix to form a closed mixing receptacle containing the mix;

said mixing head pivotably mounted relative to a frame such that the mixing receptacle formed from the mixing head and container can be pivoted to execute the mixing process;

said mixing head having a mix stream producing device and at least one rotary-driven mixing tool interacting in a mix stream;

the mix-stream-producing device producing a low-energy primary mix-stream functioning as a feed stream to supply the mix contained in the mixing receptacle to the at least one mixing tool;

the at least one mixing tool interacting in the primary mix-stream to produce a secondary mix-stream, which performs the actual mixing process, as a cross-stream to the primary mix-stream, the secondary mix-stream containing only a fraction of the mix contained in the mixing receptacle;

the mix-stream-producing device is a rotary-driven, container-scraper feed tool which produces a primary mix-stream that moves concentrically to a rotational axis of the feed tool, said container-scarping feed tool having at least one paddle; and the at least one mixing tool is positioned between a travel path of the paddle of the feed tool and a shaft of the feed tool.

2. The mixing machine of claim 1, wherein the feed tool includes at least one feed arm formed as a helix segment, which is disposed pivotably in a radial direction relative to the shaft of the feed tool outside the at least one mixing tool.

3. The mixing machine of claim 2, wherein the feed arm further comprises above the paddle a recess pointing radially inward with an edge of the recess pointing to the floor of the mixing head a radial distance from the shaft of the feed tool allowing for a certain amount of play greater than the distance between the shaft of the mixing tool and the shaft of the feed tool.

4. The mixing machine of claim 2, wherein the feed tool has several feed arms disposed at the same angular distance from one another.

5. The mixing machine of claim 3, wherein the feed tool has several feed arms disposed at the same angular distance from one another.

6. The mixing machine of claim 1 further comprising at least one auxiliary tool attached to the shaft of the feed tool, the radial extension of the auxiliary tool is less than the distance between shaft of the mixing tool and the shaft of the feed tool.

7. The mixing machine of claim 1 wherein the mixing tool is a dispersing tool or a homogenizing tool.

8. The mixing machine of claim 3 wherein the mixing tool is a dispersing tool or a homogenizing tool.

9. The mixing machine of claim 1, wherein the longitudinal axis of the shaft of the mixing tool is at an angle to the shaft of the feed tool.

10. The mixing machine of claim 3, wherein the longitudinal axis of the shaft of the mixing tool is at an angle to the shaft of the feed tool.

11. The mixing machine of claim 1 wherein the mixing machine has at least two mixing tools, one of which is a dispersing tool and another is a homogenizing tool.

12. The mixing machine of claim 1 wherein the mixing machine has at least two mixing tools, one of which is a dispersing tool and another is a homogenizing tool.

13. The mixing machine of claim 3 wherein the mixing machine has at least two mixing tools, one of which is a dispersing tool and another is a homogenizing tool.

14. The mixing machine of claim 7 wherein the homogenizing tool is a type of coil.

* * * * *